US007285190B2

(12) United States Patent
Martin, Jr.

(10) Patent No.: US 7,285,190 B2
(45) Date of Patent: Oct. 23, 2007

(54) CORROSION GUARD

(76) Inventor: Edgar Virgil Martin, Jr., 3331 Reed Rd., Escondido, CA (US) 92027

( * ) Notice: Subject to any disclaimer, the term of this patent is extended or adjusted under 35 U.S.C. 154(b) by 217 days.

(21) Appl. No.: 11/080,097

(22) Filed: Mar. 14, 2005

(65) Prior Publication Data

US 2005/0230243 A1 Oct. 20, 2005

Related U.S. Application Data

(60) Provisional application No. 60/555,869, filed on Mar. 24, 2004.

(51) Int. Cl.
*C23F 13/06* (2006.01)

(52) U.S. Cl. ..... 204/196.15; 204/196.21; 204/196.31; 204/196.36; 204/196.37

(58) Field of Classification Search ..... 204/196.15, 204/196.21, 196.36, 196.37, 196.31
See application file for complete search history.

(56) References Cited

U.S. PATENT DOCUMENTS 4,342,290 A * 8/1982 Drakulic ..... 123/41.47
5,062,987 A * 11/1991 Turcotte et al. ..... 510/184
5,563,585 A * 10/1996 MacDonald ..... 340/626
6,770,177 B2 8/2004 Keller et al.

* cited by examiner

*Primary Examiner*—Bruce F. Bell
(74) *Attorney, Agent, or Firm*—Felix L. Fischer

(57) ABSTRACT

A corrosion guard is provided with a fitting having hose mating stubs extending from a central body, the stubs sized to be insertable in an existing hose of a cooling system as typical in an automotive or truck application. The central body incorporates a flange with a threaded bore which receives a sacrificial anode element and a grounding stud extends from the boss for electrical connection to a grounded element of the vehicle or cooling system components.

7 Claims, 2 Drawing Sheets

CORROSION GUARD

REFERENCES TO RELATED APPLICATIONS

The present application claims priority of the provisional application having Ser. No. 60/555,869 filed on Mar. 24, 2004 entitled Corrosion Guard.

BACKGROUND OF THE INVENTION

1. Field of the Invention

This invention relates generally to the field of automotive cooling systems and, more particularly, to a corrosion guard comprising a fitting insertable into a cooling system hose and having a boss for a removable sacrificial anode.

2. Description of the Related Art

Metal parts in automotive cooling systems, such as radiators, heater cores, intake manifolds, timing chain covers and freeze plugs deteriorate due to corrosion created by the cooling fluids. The advancement of engine design using greater quantities of aluminum alloys for these components has exacerbated the corrosion issue. Galvanic corrosion is a significant contributor to the overall corrosion load experience by cooling system components of dissimilar metal alloys. Current corrosion protection techniques include the use of chemical additives and coolants in the cooling circulation loop.

Hot water heaters, compressor systems and certain heat exchanger systems employ sacrificial anode systems to reduce galvanic corrosion effects. Exemplary of this prior art is U.S. Pat. No. 6,770,117 to Keller, et al. issuing on Aug. 4, 2004 and entitled Cathodic Protection System for Air Compressor Tanks. Direct modification of existing automotive cooling systems to accommodate insertion of such sacrificial anodes into the components directly is not feasible due to the cost and complexity of such modifications.

It is therefore desirable to provide a corrosion guard which is easily retrofitted to existing automotive cooling systems without requiring excessive modification.

It is further desirable that corrosion guard employ removable sacrificial anodes to allow replacement as necessary.

SUMMARY OF THE INVENTION

The present invention provides corrosion guard for insertion in a cooling system hose having a body with a central cavity and two hose connections extending from the body and communicating with the central cavity. A flange in the body removably receives a sacrificial anode to extend into the central cavity and a threaded stud is provided for connecting the body to an electrical ground with an appropriate grounding wire.

BRIEF DESCRIPTION OF THE DRAWINGS

An embodiment which demonstrates the characteristics of the invention is set forth in the following detailed description. The embodiment, both as to its construction and its method of operation, together with additional advantages thereof, will be best understood from the following description when read and understood in connection with the accompanying drawings.

DETAILED DESCRIPTION OF THE INVENTION

Figure 1:
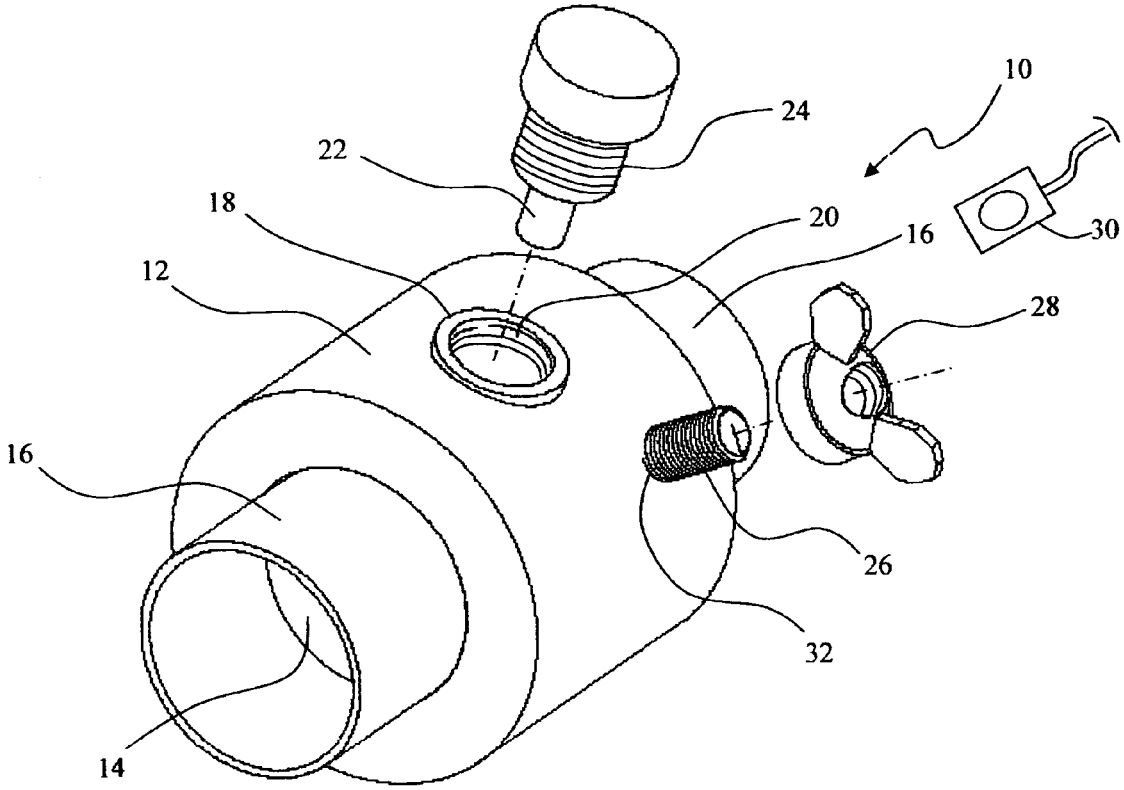
FIG. 1 is an isometric view of a corrosion guard according to the present invention.
Figure 2:
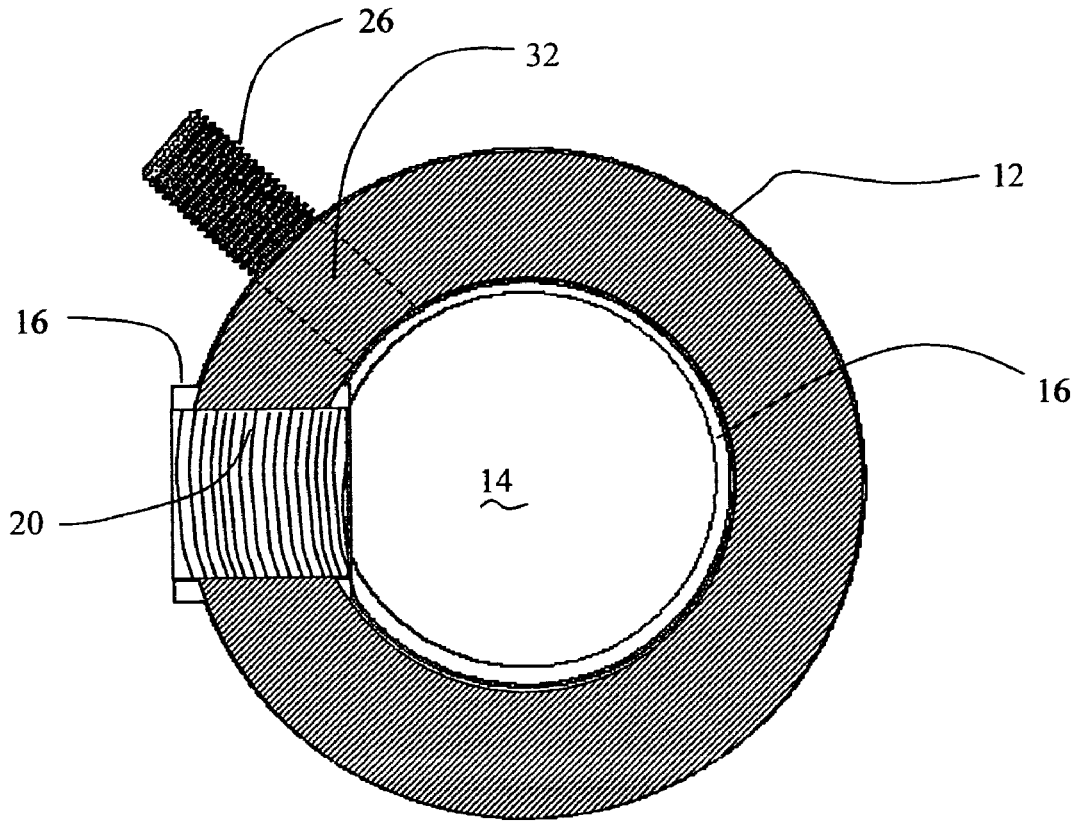
FIG. 2 is an end sectional view of the elements of the invention along line 2-2 in FIG. 1.

Referring to the drawings, FIGS. 1 and 2 show an exemplary embodiment of the invention for a standard automotive application. The corrosion guard 10 includes a body 12, which for the embodiment shown is substantially cylindrical, with an inner cavity 14. Hose mating stubs 16 extend from each side of the body to act as hose connections received in a cooling hose, as will be described in greater detail subsequently. A flange 18 extends from the body and incorporates a threaded bore 20. A sacrificial anode 22 attached to a threaded plug 24 is received within the bore of the flange and extends into the cavity of the body to be maintained in the flow of coolant. While for the embodiment shown in the drawings, the bore is threaded, alternative embodiments employ an extended neck on the flange with external threads to accept a cap with internal threads.

A grounding stud 26 extends from the body for electrical connection to a grounding element on the vehicle or cooling system components. The drawings show a threaded stud to accept a wing nut 28 or other securing mechanism for attachment of ground wire 30 to the stud. The stud in the embodiment shown is received in a second threaded bore 32 in the body. Alternative means of attachment for the grounding stud to the body or a direct ground wire attachment providing acceptable electrical connection are employed in other embodiments of the invention.

For an exemplary application of the invention, the corrosion guard body is brass 2¼ inch O.D. tubing 1½ inches in length. The hose connections are 1⁵⁄₁₆ inch O.D. brass tubing of approximately 1¾ inch length inserted approximately ¼ inch into the I.D. of the tubing of the body leaving a central cavity in the body and extending 1½ inch from the body. The hose connections are brazed into the body for leak tight connection in the embodiment shown. Threaded connection is employed in alternative embodiments. The flange is a ½ inch brass pipe flange brazed into a receiving bore in the body and an E-2 zinc anode is employed. In an exemplary embodiment, an anode and plug custom produced by Conex Metals of Bombay, India, having a business address of 39-41.2-F, 9. Yusuf Bldg. A. R. Street, Bombay 400 003 INDIA and an administrative office address of 1406, 14$^{th}$ Floor, Dalamal Towers, Nariman Point. Bombay—400 021 INDIA, has proved effective. Alternative anodes from ⅛ to ½ inch and in varying lengths are employed in other applications with appropriate modification of the flange to accept the altered size. The grounding stud is a ¼×20½ inch N/C brass stud and a brass wing nut is employed. Alternative thread pitch and diameter are employed in other embodiments. A 5 foot ground wire, which may be cut to appropriate size, allows attachment of the stud to an appropriate ground. In alternative embodiments, the body and hose connections are machined as a single part or as multiple parts from brass stock.

An example of a standard automotive installation of the corrosion guard incorporating the present invention as described above is accomplished by parting the radiator inlet hose or the heater inlet hose (from the water pump or radiator to the heater) and inserting the hose connections extending from the body into the hose ends using a hose clamp to seal the hose ends to the brass tubes. An exemplary embodiment of the invention has been retrofit onto a 1998 Chevrolet 1-ton pickup with a 7.4 liter engine. Test results indicate that deterioration of aluminum engine parts has been arrested based on the installation of the invention.

Having now described the invention in detail as required by the patent statutes, those skilled in the art will recognize modifications and substitutions to the specific embodiments disclosed herein. Such modifications are within the scope and intent of the present invention as defined in the following claims.

What is claimed is:

1. A corrosion guard for insertion in a cooling system hose comprising:

a metallic body having a central cavity;

two hose connections extending from the body and communicating with the central cavity;

a flange in the body adapted to removably receive a sacrificial anode; and, means for connecting the metallic body to an electrical ground, said anode removable without disconnection of the connecting means.

2. A corrosion guard as defined in claim 1 wherein the connecting means comprises: a threaded stud extending from the body;

a nut received on the stud; and, a conductive cable attached to the electrical ground and secured to the threaded stud using the nut.

3. A corrosion guard as defined in claim 1 wherein the body is substantially cylindrical.

4. A corrosion guard as defined in claim 3 wherein the body is brass.

5. A corrosion guard as defined in claim 3 wherein the hose connections are substantially cylindrical having an outer diameter sealing received in an inner diameter of the body.

6. A corrosion guard as defined in claim 1 wherein the flange incorporates and internal threaded bore to receive an anode having a threaded plug.

7. A corrosion guard for insertion in a cooling system hose comprising:

a substantially cylindrical brass body having an inner diameter forming a central cavity;

two substantially cylindrical brass hose connections having an outer diameter closely received within the inner diameter of the body and brazed thereto, extending from the body and having an inner diameter for fluid communication with the central cavity;

a flange in the body having a threaded bore communicating with the central cavity to removably receive a sacrificial zinc anode with a threaded plug;

a threaded stud received in a second threaded bore in the body and extending from the body;

a nut received on the stud; and, a conductive cable attached to an electrical ground and secured to the threaded stud using the nut.

* * * * *